US006662846B1

(12) United States Patent
Hanright

(10) Patent No.: US 6,662,846 B1
(45) Date of Patent: Dec. 16, 2003

(54) WASHABLE WINDOW SHADE WITH REMOVABLE COMPONENTS

(76) Inventor: Connie A. Hanright, P.O. Box 1045, Rome, NY (US) 13442

( * ) Notice: Subject to any disclaimer, the term of this patent is extended or adjusted under 35 U.S.C. 154(b) by 0 days.

(21) Appl. No.: 10/246,566

(22) Filed: Sep. 17, 2002

(51) Int. Cl.[7] ..... A47H 5/00
(52) U.S. Cl. ..... 160/84.01
(58) Field of Search ..... 160/84.01, 84.03, 160/84.04, 84.05, 84.06, 123, 178.1 R, 124, 243

(56) References Cited

U.S. PATENT DOCUMENTS

| | | | | | |
|---|---|---|---|---|---|
| 904,298 | A | * | 11/1908 | Bell | 160/84.01 |
| 1,084,761 | A | * | 1/1914 | Steele | 160/84.01 |
| 1,212,270 | A | * | 1/1917 | Smith | 160/84.01 |
| 1,280,699 | A | * | 10/1918 | Forse | 160/84.01 |
| 1,482,978 | A | * | 2/1924 | Edwards | 160/84.01 |
| 1,498,594 | A | * | 6/1924 | Watson | 160/84.01 |
| 3,528,477 | A | * | 9/1970 | Abraham | 160/84.01 |
| 3,777,800 | A | * | 12/1973 | Susoev | 160/84.01 |
| 4,934,435 | A | * | 6/1990 | Regev | 160/84.01 |
| 4,986,329 | A | * | 1/1991 | Kupchunos | 160/84.01 |
| 5,634,244 | A | * | 6/1997 | Fetsch et al. | 160/178.1 R |
| 5,690,156 | A | * | 11/1997 | Ruggles | 160/84.04 |
| 5,738,159 | A | * | 4/1998 | O'Brien | 160/84.01 |
| 5,988,254 | A | * | 11/1999 | Hanright | 160/84.01 |
| 6,431,245 | B1 | * | 8/2002 | Shen | 160/84.03 |
| 6,497,264 | B1 | * | 12/2002 | Paskevicius | 160/84.04 |

* cited by examiner

*Primary Examiner*—David Purol
(74) *Attorney, Agent, or Firm*—Weiner & Burt, P.C.; Irving M. Weiner; Pamela S. Burt

(57) ABSTRACT

A washable window shade having a support mechanism similar to that used on mini-blinds which may use a single drawstring which proceeds down through the middle of the shade and goes through the middle of the bottom flat member. The shade includes a plurality of horizontal stiffening members.

6 Claims, 4 Drawing Sheets

FIG 1
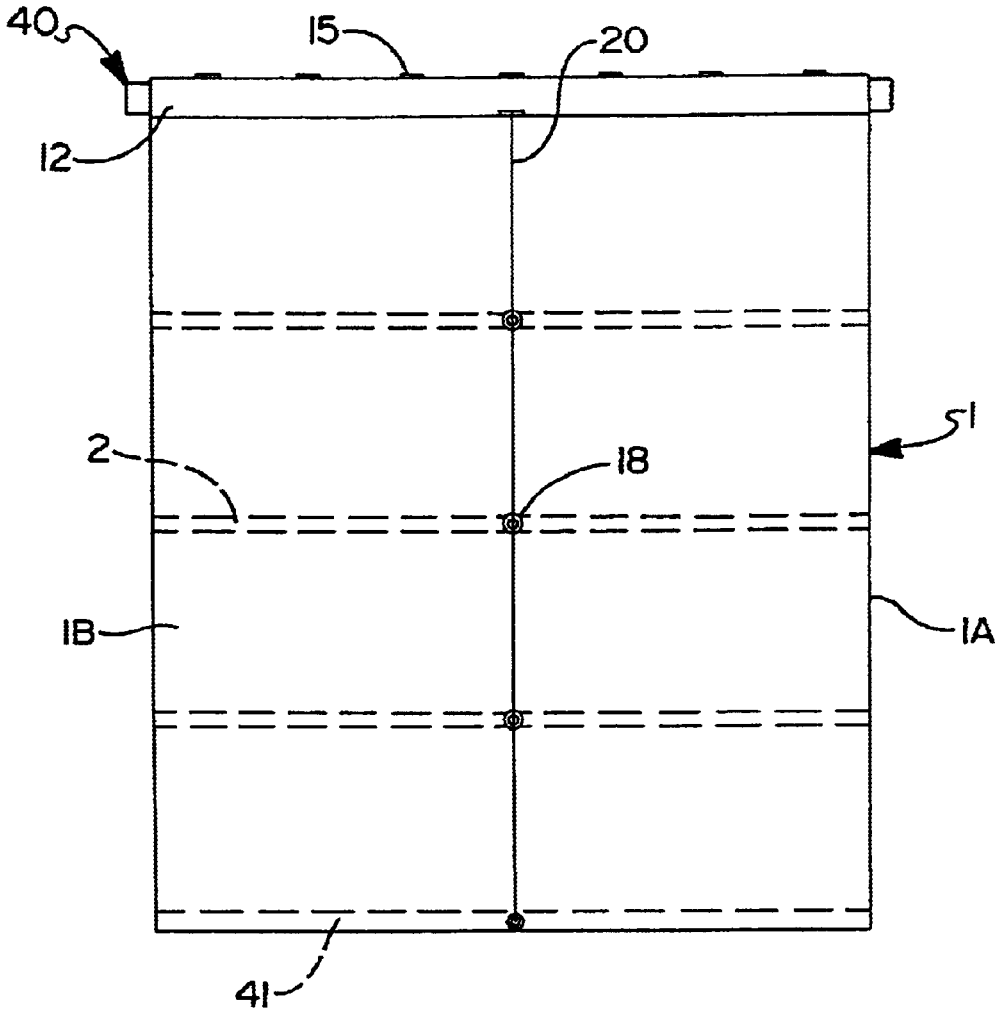
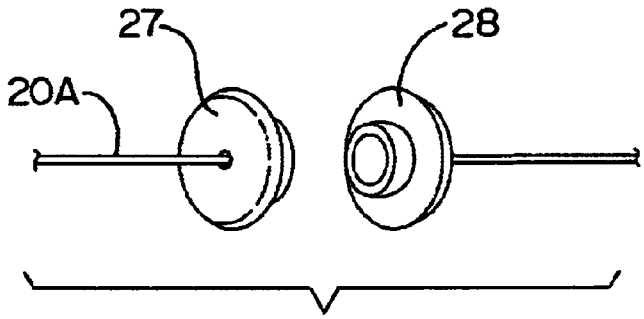
FIG 2

FIG 3
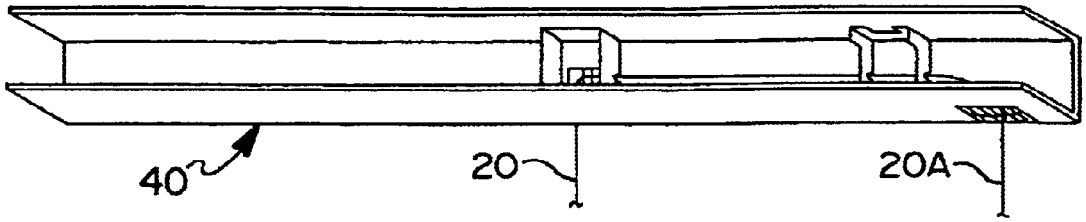
FIG 4
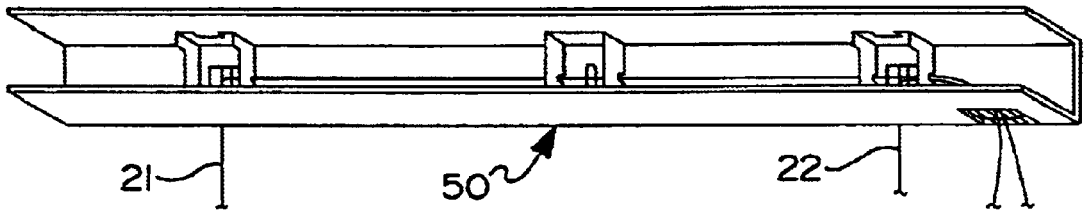
FIG 5
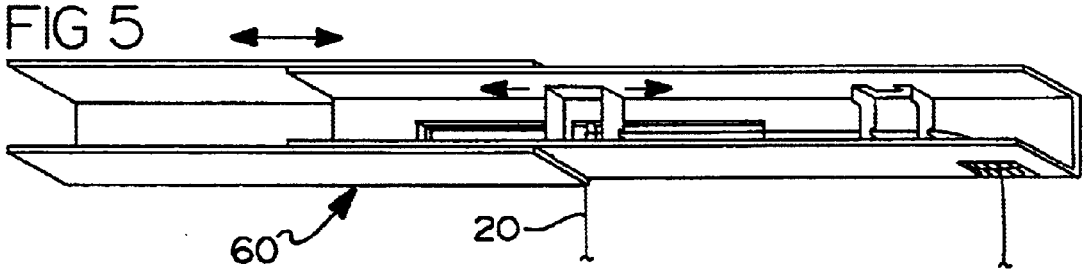
FIG 6
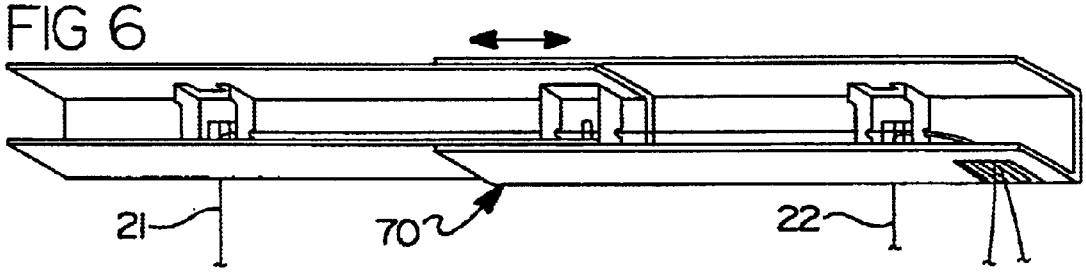
FIG 7
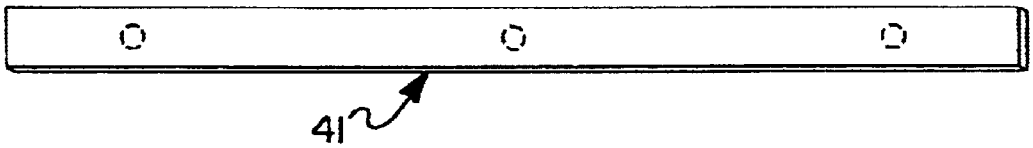
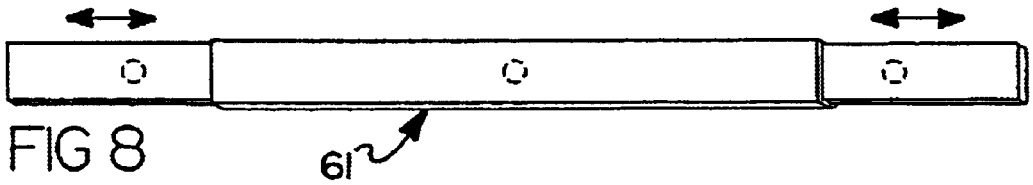
FIG 8

FIG 11
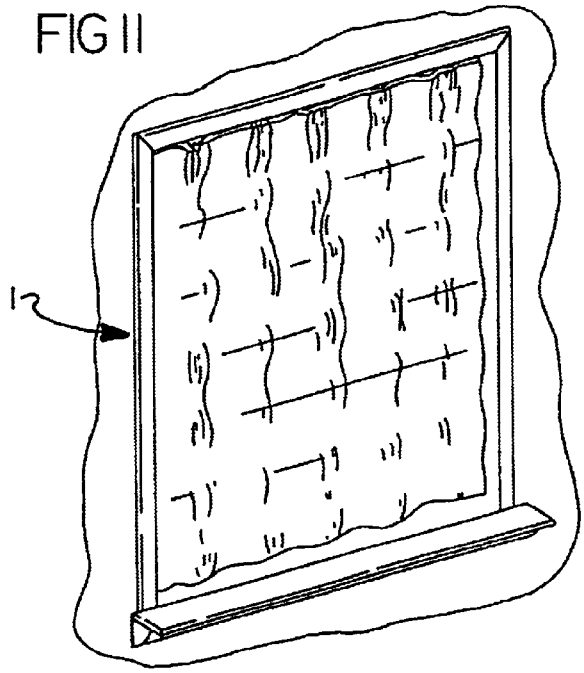
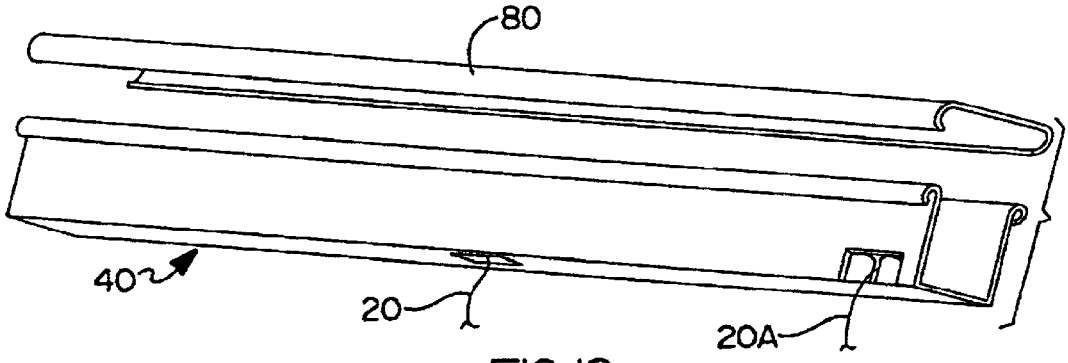
FIG 12

WASHABLE WINDOW SHADE WITH REMOVABLE COMPONENTS

BACKGROUND OF THE INVENTION

1. Field of the Invention

The present invention relates generally to a window shade which may be easily assembled and disassembled so that non-washable components can be readily removed to permit washing, by hand or machine, of the main window shade member. More particularly, the invention relates to a multi-component window shade having a number of components which may be readily removed and re-assembled without the use of tools, and a main shade member which is washable by hand or machine once the other components are removed.

It will be understood that the terminology "washable" as employed herein is intended to connote any form of washing or cleaning of the window shade, including by hand, by machine, and/or by dry cleaning or the like.

2. Description of the Relevant Art

Conventional window shades have an integral tension mechanism including an upper support rod around which the main shade member is wound and unwound to permit raising and lowering of the shade. Typically, the main shade member is fabricated of vinyl or the like, and is integrally attached to the upper support rod provided with the tension mechanism. Over time, the conventional window shade becomes soiled, dusty, and/or discolored, eventually becoming so unsightly as to require replacement. While some limited cleaning of the shade may be possible by hand wiping or the main shade member, effective and thorough cleaning of the shade is impossible due to the integral construction of non-washable components.

Other known window treatments, such as blinds, are likewise subject to becoming dirty and/or discolored over time, without being capable of thorough washing. Conventional curtains or drapes, on the other hand, may be removed from their hanging supports (such as curtain rods and/or drapery hooks), so that they are capable of thorough washing or dry cleaning. However, conventional curtains and drapes are incapable of being vertically raised and lowered in the manner of window shades, while also lacking the more tailored appearance of window shades.

The present invention effectively overcomes the foregoing disadvantages associated with conventional window coverings by providing a window shade having the functional attributes of a conventional window shade while permitting thorough washing, by hand or machine, of the main member.

The most relevant art is applicant's U.S. Pat. No. 5,988,254 which issued Nov. 23, 1999. The present invention is an improvement on applicant's earlier invention and is less expensive to manufacture. The present invention may use only one or two drawstrings in place of two drawstrings, and the shade is not hung on a cafe rod.

SUMMARY OF THE INVENTION

The present invention provides a washable window shade having a substantially rectangular main shade member fabricated of flexible, washable material. Upper retaining means are provided along an upper edge portion of the main shade member. The upper retaining means includes means for removably securing the shade to a mechanism which is similar to that used on mini-blinds. However, such mechanism may, in one embodiment, use only one string, which proceeds down through the middle of the rod and goes through the middle of a bottom flat member.

Also provided are lower retaining means for removably receiving and retaining therein a substantially rigid elongated bottom member, the lower retaining means being provided along a lower edge portion of the main shade member. The washable window shade further includes stiffening means for maintaining the main shade member in a substantially flat configuration in an open position, the stiffening means comprising a plurality of spaced apart, substantially rigid elongated members. A plurality of intermediate retaining means are provided for removably receiving and retaining therein the plurality of stiffening members respectively, the plurality of intermediate retaining means extending substantially horizontally across spaced-apart intermediate portions of the main shade member. Operating means are provided for raising and lowering the main shade member, the operating means extending from a lower portion to an upper portion of the main shade member. In a first embodiment, the stiffening members are also removable before washing, while in a second embodiment the stiffening members remain in the main shade member while it is washed.

It is an object of the invention to provide an aesthetically appealing and practical window shade which permits convenient removal of non-washable components prior to washing or dry cleaning, without the use of tools.

A further object of the invention is to provide a washable window shade which can be conveniently re-assembled after the main shade member is washed, without requiring any tools.

The above and further objects, details, and advantages of the present invention will become apparent from the following detailed description, when read in conjunction with the accompanying drawings.

BRIEF DESCRIPTION OF THE DRAWINGS

FIG. 1 is a rear view of a washable window shade according to the invention, as mounted to cover a window.

FIG. 2 illustrates an optional break-away device for the pull string of the mechanism.

FIG. 3 is a perspective view of the upper non-expandable mechanism using one drawstring.

FIG. 4 illustrates a second embodiment of the invention having a non-expandable upper mechanism utilizing two drawstrings.

FIG. 5 illustrates a third embodiment which employs an expandable upper mechanism using one drawstring.

FIG. 6 illustrates a fourth embodiment utilizing an expandable upper mechanism with two drawstrings.

FIG. 7 illustrates a non-expandable bottom flat member.

FIG. 8 illustrates an expandable bottom flat member.

FIG. 11 is a front perspective view of a washable window shade according to the third embodiment of the invention, as mounted to cover a window.

FIG. 12 is a perspective view of a top member for the support mechanisms shown in FIGS. 3–6.

DETAILED DESCRIPTION OF PREFERRED EMBODIMENTS

Figure 9:
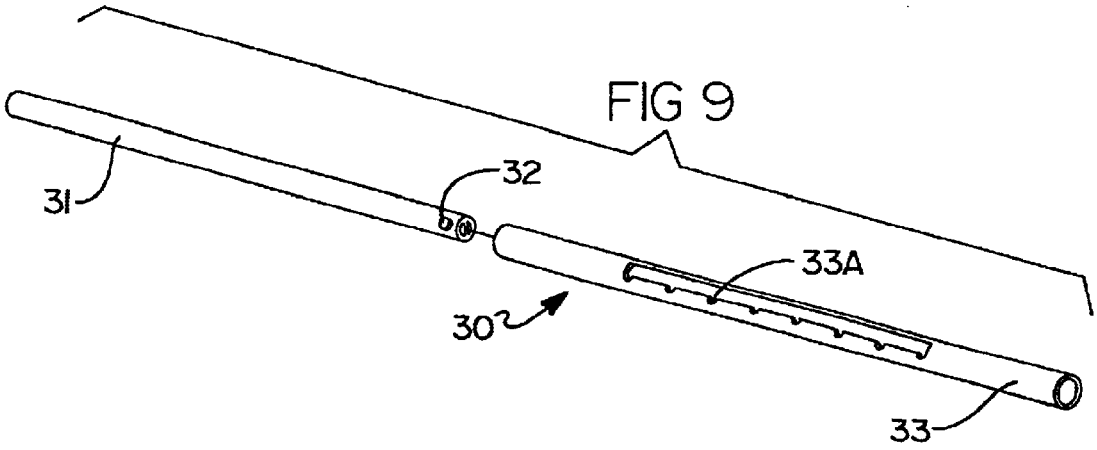
FIG. 9 is a perspective view of a telescoping pole employed in the third embodiment of the washable window shade of the invention, as disassembled.

With reference to FIGS. 1, 2, 3 and 7, a first preferred embodiment of the washable window shade 1 according to the invention will be described. The washable window shade 1 as shown in FIG. 1 is mounted to cover a window (not shown).

The washable window shade 1 according to the invention comprises a substantially rectangular shade member having a front side 1A which faces into the room, and a back side 1B facing the window. The shade 1 is fabricated of two co-extensive layers of flexible material which are stitched or otherwise joined together along side edge portions thereof, top of bottom portions thereof and intermediate horizontal pocket portions thereof, as described in greater detail below, so that the front side 1A is defined by a first sheet of material and the back side 1B is defined by a second sheet of material.

The material used in fabricating the shade 1 may comprise any suitable fabric having desired decorative and light-blocking qualities, such as silk, cotton, or any other natural or synthetic material or blend of materials. To enhance the light blocking effect of the shade 1, heavier or relatively opaque fabric may be employed.

It will be understood that while the two sheets of fabric defining front side 1A and back side 1B of the shade 1 may be the same material with the same color(s) or pattern(s), the two sheets may alternatively comprise different fabrics so that the front and back sides of the shade will have different appearances. By way of example, it may be desirable to use a decorated colored or patterned fabric for the front side of the shade which faces the room, while using a white fabric or one which blends well with the exterior of a building, for example, for the back side of the shade. Regardless of the particular fabric(s) used to construct shade 1, an important quality of the fabric is that it be washable, either by hand and/or machine, ro suitable for being dry cleaned.

As shown in FIG. 1, the shade 1 comprises stiffening means in the form of a plurality of substantially horizontal stiffeners 2 extending entirely across the width of shade 1. The stiffeners 2 function to support retainers for a drawstring as will be described below, while also functioning to hold the relatively flexible material of shade 1 substantially flat without bending or curling along the edges. While three stiffeners 2 are show in FIG. 1, it will be understood than any desired number of stiffeners may be provided, depending upon such variables as the length and width of the window and the type of fabric employed for shade 1.

The stiffeners 2 comprise intermediate retaining means in the form of horizontal, elongated pockets formed in shade 1. Each pocket may be defined by a pair of parallel stitch lines extending across the width of the shade so as to join the two layers of shade 1 together along the stitch lines, and thereby define a pocket therebetween. Stiffeners 2 further comprise a stiffening element which may take the form of a relatively rigid rod made of plastic or the like inserted into each of the thus-formed pockets. Where the stiffening element is provided in the form of a rod, one end of each elongated pocket defined in shade 1 may be provided with or without a closure means permitting selective opening and closing of the pocket end so as to remove the rod therefrom. Optionally, the elongated pocket may be left open when using a plastic rod.

The closure means may comprise a snap closure a Velcro® type closure. Any suitable closure means may be employed, provided that it permits convenient opening and closing of the end of the pocket for removal and insertion of the rod. Preferably, the open pocket ends of the respective stiffeners 2 are provided along the same side of shade 1, while the opposite ends of the pockets along the opposite side of shade 1 may preferably be stitched or otherwise permanently closed. In this respect it will be understood that the side edges of the front and back sides 1A, 1B of shade 1 are joined together by stitching or the like substantially entirely along their lengths, with the exception of the ends of the pockets of stiffeners 2, as described.

Instead of rods, the stiffening elements of stiffeners 2 may alternatively comprise stiffening material stuffed relatively tightly into the elongated pockets. The stiffening material may comprise any suitable material which is relatively stiff or form retentive when stuffed into the stiffener pockets, and washable. By way of example, the stiffening material may comprise closely packed fabric, facing material such as used by seamstresses, foam material, etc. When the stiffening elements comprise such stiffening material, both ends of each elongated pocket of stiffeners 2 are preferably permanently closed by stitching or the like, because the washable stiffening material is adapted to remain within the pockets during washing.

In addition to the stiffeners, 2, the shade 1 is provided with a substantially rigid bottom member 41 or 61, such as the type shown in FIG. 7 or 8. With reference to FIG. 7, there is shown a bottom member 41 which preferably, but not necessarily, includes a single flat plastic member. With reference to FIG. 8, there is shown an expandable multi-piece bottom member 61, for accommodating various shade widths. The bottom member 41 or 61 is adapted to be inserted in a suitable pocket on the lower portion of the shade 1.

The top of shade 1 is supported by a support mechanism 40, 50, 60 or 70 (as shown in FIG. 3, 4 5 or 6, respectively) for mounting the window shade to a window frame or surrounding wall portion. To this end, provided along the top edge of shade 1 is upper retaining means which may take the form of an elongated horizontal pocket 12 extending across the entire width of shade 1. To facilitate insertion of the support mechanism 40, 50, 60 or 70 into top pocket 12, a plurality of snap closure elements 15 or the like may preferably be provided at regular intervals along top open edges of pocket 12. The snap closures 15 also permit access to a central drawstring 20, which can be accessed simply by unsnapping several of the central snap closures.

"The drawstring arrangement which permits opening and closing of shade 1 will now be described. As shown in FIG. 1, a single drawstrings 20 extends along the back side of 1B of shade 1. The drawstring 20 extends through a plurality of drawstring retainers tabs 18. The retainers 18 are secured by stitching or the like to the backside of the pocket of bottom member 41 or 61 and the pockets of stiffeners 2. Retainers 18 may be fabricated of any suitable material which is strong enough to withstand the stress applied by the drawstring, and which is washable. Each retainer 18 is provided with a small eyelet or reinforced aperture through which the drawstring 20 extends. It is contemplated that the retainers 18 may alternatively comprise small plastic rings sewn in the appropriate positions, or any other suitable means for guiding the drawstring and which is washable."

FIGS. 3–6 show alternative forms of support mechanisms in accordance with the present invention. Such support mechanisms are similar, but not identical to, mechanisms used with conventional mini-blinds.

FIG. 3 shows a non-expandable support mechanism 40, which employs only a single centrally-located drawstring 20.

FIG. 4 shows a non-expandable support mechanism 50, which employs two drawstrings 21 and 22, respectively.

FIG. 5 shows an expandable support mechanism 60, which employs a centrally-located single drawstring 20.

FIG. 6 shows an expandable support mechanism 70, which employs two drawstrings 21 and 22, respectively.

FIG. 2 shows an optional breakaway pull string for controlling the operating means of the support mechanism. As explained above, there may be a single pullstring or two pullstrings, depending on the support mechanism employed. For example, as shown in FIG. 3, pullstring 20A comprises the portion of drawstring 20 which is pulled by the user. The breakaway mechanism in the pullstring 20A comprises two snap members 27 and 28 which are shown in FIG. 2.

The third embodiment of the invention which permits adjustment to accommodate windows of varying widths will not we described with reference to FIGS. 5, 6 and 8–11. The washable window shade of the third embodiment is substantially the same as described above with respect to the first embodiment, except that adjustable poles are employed instead of the fixed size stiffeners of the first embodiment, and expandable top and bottom members are used.

Figure 10:
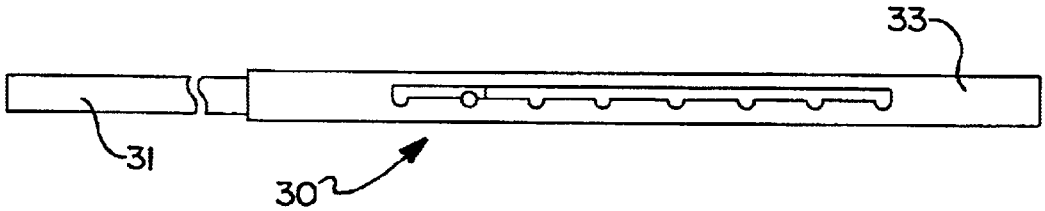
FIG. 10 is a view of the telescoping pole of FIG. 9, as assembled.

In the third embodiment, the stiffeners 2 are similar to those described above with respect to the first embodiment inasmuch as a plurality of horizontal pockets are provided across the width of the shade 1 and closure means for selectively closing one end of the pockets are provided. In this embodiment, however, the stiffeners are replaced by expandable poles in the form of a telescoping pole 30 as shown in FIGS. 9 and 10. The poles 30 are preferably substantially cylindrical and hollow, and are fabricated of a lightweight rigid material such as plastic.

Each pole 30 comprises a first section 31 provided with a spring-biased pushbutton 32 which is normally biased outwardly but which may be pushed inwardly. The pole 30 further comprises a second section 33 having a slightly larger diameter than first section 31 so that first section 31 is closely received within second section 33 as shown in FIG. 10. The second section 33 is provided with an elongated slot having a series of spaced apart cut-away indents 33A provided along one edge thereof. The indents 33A are provided at regular intervals of one inch, one-half inch, or other desired increments. The slot provided with indents 33A is dimensioned to prevent pushbutton 32 from extending therethrough except at each of the indents 33A which each define a sufficient opening for the pushbutton 32 to extend therethrough.

The pole 30 is adjusted in length simply by pushing in on pushbutton 32 and sliding pole section 31 inwardly within pole section 33 until the pushbutton 32 protrudes outwardly through the desired indent 33A. To facilitate proper adjustment, pole section 33 is preferably marked adjacent each of the indents 33A with a number (not shown) corresponding to the overall width dimension of the pole 30 when the pushbutton 32 is engaged within any given one of the indents. For example, if the indents 33A are spaced at regular one-inch intervals, the indents would be marked 31, 32, 33, etc., corresponding to the final width in inches of the pole 30 as adjusted.

By virtue of the adjustability of poles 30, the washable window shade of the third embodiment of the invention can be readily adjusted, without the use of tools, to accommodate windows, and shades 1 of varying width dimensions. In addition, a fuller, gathered, or ruffled appearance is achieved by making the shade 1 oversized in width relative to the width dimension of the window, to achieve the gathered appearance shown in FIG. 1. To this end, elastic strips or beads (not shown) may preferably be stitched to the back side 1B of shade 1 substantially across the width thereof, such as along a seam of each of the respective pockets of poles 30 and expandable bottom member 61. Preferably, each elastic strip or beads extends across the width of shade 1 to within approximately one inch from each side edge. The elastic as thus provided will serve to gather the shade 1 in an aesthetically pleasing manner as shown from the front in FIG. 11.

FIG. 12 shows a top member 80 which can be used in the upper mechanism 40, 50, 60 or 70 of FIG. 3, 4, 5 or 6, respectively. The member 80 may preferably, but not necessarily, be made of plastic.

The top member 80 can slide of mechanism 40, 5.0, 60 or 70 to strengthen the structure of its associated mechanism.

While there have been described above what are at present considered to be the preferred embodiments of the invention, it will be understood that various modifications may be made therein without departing from the spirit and scope of the invention. The present embodiments are therefore to be considered in all respects as illustrative, and not restrictive. The scope of the invention is indicated by the appended claims rather than by the foregoing description.

What is claimed is:

1. A washable window shade comprising:

a substantially rectangular main shade member fabricated of flexible, washable material;

upper retaining means for removably receiving and retaining therein a support mechanism, said upper retaining means being provided along an upper edge portion of said shade member;

said support mechanism being adapted to support said window shade from external support surfaces adjacent a window pane to be covered;

lower retaining means for removably receiving and retaining therein a substantially rigid elongated bottom member, said lower retaining means being provided along a lower edge portion of said main shade member, stiffening means for maintaining said main shade member in a substantially flat configuration in an open position, said stiffening means comprising a plurality of spaced apart, substantially rigid elongated members;

a plurality of intermediate retaining means for removably receiving and retaining therein said plurality of stiffening members respectively, said plurality of intermediate retaining means extending substantially horizontally across spaced-apart intermediate portions of said shade member;

said support mechanism including operating means for raising and lowering said main shade member;

said operating means for raising and lowering said main shade members includes no more than one drawstring, and a set of drawstring retainers arranged in a spaced-apart relation on said back side of said main shade member; and said support mechanism, said bottom member, said stiffening means, and said operating means being removable from said main shade member without the use of tools.

2. A washable window shade according to claim 1, wherein:

said main shade member comprises first and second substantially co-extensive layers of fabric;

said first layer of fabric defines a front side of said main shade member which faces into a room when said window shade is in an installed position; and said second layer of fabric defines a back side of main shade member which faces a window when said window shade is in an installed position.

3. A washable window shade according to claim 1, wherein:

said drawstring retainers are affixed to back side portions of said intermediate pockets.

4. A washable window shade according to claim 1, including:

a breakaway pullstring for controlling said operating means.

5. A washable Window shade comprising:

a substantially rectangular main shade member fabricated of flexible, washable material;

upper retaining means for removably receiving and retaining therein an expandable support mechanism, said upper retaining means being provided along an upper edge portion of said main shade member;

said support mechanism being adapted to support said window shade from external support surfaces adjacent a window pane to be covered;

lower retaining means for removably receiving and retaining therein a substantially rigid elongated bottom member, said lower retaining means being provided along a lower edge portion of said main shade member;

stiffening means for maintaining said main shade member in a substantially flat configuration in an open position, said expandable support mechanism including operating means for raising and lowering said main shade member; and said support mechanism, said bottom member, and said operating means being removable from said main shade member without the use of tools;

said operating means for raising and lowering main shade member includes a single drawstring, and a plurality of drawstring retainers arranged in spaced-apart relation on a back side of said main shade member, said plurality of drawstring retainers being arranged in a substantially vertically spaced-apart relationship on said back side of said main shade member; and said support mechanism being expandable to accommodate windows of varying widths.

6. A washable window shade comprising:

a substantially rectangular main shade member fabricated of flexible, washable material;

upper retaining means for removably receiving and retaining therein an expandable support mechanism, said upper retaining means being provided along an upper edge portion of said main shade member;

said support mechanism being adapted to support said window shade from external support surfaces adjacent a window pane to be covered;

lower retaining means for removably receiving and retaining therein a substantially rigid elongated bottom member said lower retaining means being provided along a lower edge portion of said main shade member;

stiffening means for maintaining said main shade member in a substantially flat configuration in an open position, said expandable support mechanism including operating means for raising and lowering said main shade member;

said support mechanism, said bottom member, and said operating means being removable from said main shade member without the use of tools;

said main shade member comprises first and second substantially co-extensive layers of fabric;

said first layer of fabric defines a front side of said main shade member which faces into a room when said window shade is in an installed position; and said second layer of fabric defines a back side of said main shade member which faces a window when said window shade is in an installed position;

said operating means for raising and lowering main shade members includes a pair of drawstrings, and two sets of drawstring retainers arranged in spaced-apart relation on said back side of said main shade member, each said set comprising a plurality of retainers arranged in substantially vertically spaced-apart relation on said back side of said main shade member; and said support mechanism being expandable to accommodate windows of varying widths.

* * * * *